US009170545B2

(12) United States Patent
Eom

(10) Patent No.: US 9,170,545 B2
(45) Date of Patent: Oct. 27, 2015

(54) IMAGE FORMING APPARATUS AND CONTROL METHOD THEREOF

(71) Applicant: Samsung Electronics Co., Ltd., Suwon-si, Gyeonggi-do (KR)

(72) Inventor: Yoon Seop Eom, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 12 days.

(21) Appl. No.: 13/741,568

(22) Filed: Jan. 15, 2013

(65) Prior Publication Data

US 2013/0183048 A1 Jul. 18, 2013

(30) Foreign Application Priority Data

Jan. 16, 2012 (KR) ..... 10-2012-0004656

(51) Int. Cl.
*G03G 15/00* (2006.01)
*G03G 15/08* (2006.01)
*G03G 21/18* (2006.01)

(52) U.S. Cl.
CPC ..... *G03G 15/553* (2013.01); *G03G 15/0863* (2013.01); *G03G 21/1889* (2013.01)

(58) Field of Classification Search
CPC ..... G03G 15/0863; G03G 15/553; G03G 21/1889
USPC ..... 399/13, 24, 25, 26
See application file for complete search history.

(56) References Cited

U.S. PATENT DOCUMENTS 7,471,905 B2 * 12/2008 Cook ..... 399/24
2005/0084272 A1 * 4/2005 Kikuchi ..... 399/12

* cited by examiner

*Primary Examiner* — Ryan Walsh
(74) *Attorney, Agent, or Firm* — Staas & Halsey LLP

(57) ABSTRACT

An image forming apparatus configured to form a color image by having at least one consumable product, the image forming apparatus including a main board, a first memory unit detachably coupled to the main body, a consumable product memory unit installed at the consumable product, and configured to store information on a lifespan of the consumable product, and a control unit configured to read the information on the lifespan of the consumable product from the consumable product memory unit, and to store the information on the lifespan of the consumable product at the first memory unit in the form of a backup.

9 Claims, 8 Drawing Sheets

FIG.8

| | | | | |
|---|---|---|---|---|
| [General Information] | | | | |
| Firmware/Engine Version | : V1.01.01.31T Jan-12-2011 1.00.30 | | | |
| Total Page Count | : 1876/48 Page(s) (color/mono) | | | |
| Total Image Count | : 7558 Image(s) | | | |
| Platen Scan Page Count | : 15 Page(s) | | | |
| [Consumables Life] | | | | |
| Fuser Life | : 7545 Image(s) | | | |
| Transfer Roller Life | : 1921 Page(s) | | | |
| Tray Roller Life | : 1924 Page(s) | | | |
| Transfer Belt Life | : 7558 Image(s) | | | |
| [Toner Information] | | | | |
| Toner Remaining | : 0%(P4.1) | 64%(P4.1) | 80%(P5.0) | 0%(P4.5) |
| Page Count | : 1800 Page(s) | 463 Page(s) | 199 Page(s) | 1835 Page(s) |
| Serial NO. | : CRUM-10072969696 | CRUM-10073074271 | CRUM-10072974191 | CRUM-10072967299 |
| Supplier | : SAMSUNG(EXP) | SAMSUNG(EXP) | SAMSUNG(EXP) | SAMSUNG(EXP) |
| Product Date | : 2010.07 | 2010.07 | 2010.07 | 2010.07 |
| Last Used Date | : 2011.10.01 | 2011.10.01 | 2011.10.01 | 2011.10.01 |
| First Installed Date | : 2011.02.12 | 2011.02.12 | 2011.02.12 | 2011.02.12 |

IMAGE FORMING APPARATUS AND CONTROL METHOD THEREOF

CROSS-REFERENCE TO RELATED APPLICATIONS

This application claims the benefit of Korean Patent Application No. 2012-0004656, filed on Jan. 16, 2012, in the Korean Intellectual Property Office, the disclosure of which is incorporated herein by reference in its entirety.

BACKGROUND OF THE INVENTION

1. Field of the Invention

Exemplary embodiments of the present disclosure relate to an image forming apparatus configured to manage information with reference to a lifespan of a consumable product, and a control method thereof.

2. Description of the Related Art

In general, an image forming apparatus using an electrophotographing method is an apparatus configured to form an electrostatic latent image on a photosensitive medium using a light exposing unit such as a laser scanning unit (LSU) by receiving image data that corresponds to a desired image, to form a toner image by supplying a toner to the electrostatic latent image by using a developing unit, to transfer the toner image to an intermediate transfer belt, and to form a desired color image by transferring the toner image that is transferred to the intermediate transfer belt to a printing medium.

As for the image forming apparatus described above to form a color image, the image forming apparatus needs to be provided with a number of consumable products, and conventionally, through a CPU processor, the information with reference to the lifespan of the consumable product is calculated, and by storing such in a non-volatile memory part provided at a main board, the calculated information is managed. However, when replacing the main board with a new main board in a case of a defect generated at the main board, the information with reference to the lifespan of the consumable product, which is calculated and stored in the meantime, is initialized, and thus, a difficulty of being unable to manage the lifespan of the various components installed at the image forming apparatus occurs.

Meanwhile, as to resolve such difficulties, a method of separately removing a non-volatile memory part provided at the conventional main board, and reattaching the non-volatile memory part on a replaced main board is known, but this method is provided with an inconvenience in performing a replacement task of the non-volatile memory part, and during the replacement process of the non-volatile memory part, if a mistake by a user occurs (a service technician), the memory part may be damaged.

SUMMARY OF THE INVENTION

The present disclosure provides an image forming apparatus capable of storing the information on the lifespan of consumable product by having a backup of the information on the lifespan of the consumable product at a separate memory device that is detachably coupled to a main board, and a control method thereof.

Additional features and utilities of the present general inventive concept will be set forth in part in the description which follows and, in part, will be obvious from the description, or may be learned by practice of the general inventive concept.

Embodiments of the present disclosure provides an image forming apparatus configured to form a color image by having at least one consumable product, the image forming apparatus includes a main board, a first memory unit, a consumable product memory unit, and a control unit. The first memory unit may be detachably coupled to the main board. The consumable product memory unit may be installed at the consumable product, and configured to store information on a lifespan of the consumable product. The control unit may be configured to read the information of the lifespan of the consumable product from the consumable product memory unit, and to store the information of the lifespan of the consumable product to the first memory unit in the form of a backup.

The image forming apparatus may further include a second memory unit connected to the main board. The control unit may be configured to store the read information of the lifespan of the consumable product at the second memory unit in the form of a backup.

In a case when the read information on the lifespan of the consumable product is shorter than the information on the lifespan of the consumable product stored at the first memory unit or at the second memory unit in the form of a backup, the control unit may be configured to determine whether the read information on the lifespan of the consumable product is valid.

The control unit, if determined that the read information on the lifespan of the consumable product is valid, may be configured to store the information of the consumable product after updating the information of the consumable goods stored at the first memory unit or at the second memory unit.

The control unit may be configured to store the information of the lifespan of the consumable product in an encrypted manner.

Embodiments of the present disclosure also provide an image forming apparatus configured to form a color image by having at least one consumable product, the image forming apparatus includes a main board, a first memory unit, a consumable product memory unit, and a control unit. The first memory unit may be detachably coupled to the main board. The second memory unit may be connected to the main board. The consumable product memory unit may be installed at the consumable product, and configured to store information of a lifespan of the consumable product. The control unit may be configured to read the information of the lifespan of the consumable product from the consumable product memory unit, store the read information of the lifespan of the consumable product at the first memory unit in the form of a backup, and store the read information of the lifespan of the consumable product at the second memory unit in the form of another backup in a case when the first memory unit is in a defective state.

In a case when the read information of the lifespan of the consumable product is shorter than the information of the lifespan of the consumable product stored at the first memory unit in the form of a backup, the control unit may be configured to store the read information of the lifespan of the consumable product at the first memory unit as update information of the lifespan of the consumable product.

In a case when the read information on the lifespan of the consumable product is shorter than the information on the lifespan of the consumable product stored at the second memory unit in the form of a backup, the control unit may be configured to store the read information of the lifespan of the consumable product stored at the second memory unit as update information of the lifespan of the consumable product stored.

Embodiments of the present disclosure also provide an image forming apparatus configured to form a color image by having at least one consumable product, the image forming apparatus includes a main board, a first memory unit, a second memory unit, and a control unit. The first memory unit may be detachably coupled to the main board. The second memory unit may be connected to the main board. The control unit may be configured to determine whether the main board has been replaced, to copy the information of the lifespan of the consumable product stored at the first memory unit or at the second memory unit in the form of a backup, and to store the copied information to a main memory unit of a replaced main board.

The image forming apparatus may further include a manipulating panel to receive a manipulation input of a user. The control unit may be configured to select one of the first memory unit and the second memory unit according to the manipulation of the user, to copy the information of the lifespan of the consumable product stored at the selected memory unit, and to store the copied information to the main memory unit of the replaced main board.

Embodiments of the present disclosure also provide an image forming apparatus configured to form a color image by having at least one consumable product, the image forming apparatus includes a main board, a first memory unit, a second memory unit and a control unit. The first memory unit may be detachably coupled to the main board. The second memory unit may be connected to the main board. The control unit may be configured to determine whether the first memory unit has been replaced, to copy information of a lifespan of the consumable product stored at a main memory unit of the main board or information of a lifespan of the consumable product stored at the second memory unit in the form of a backup, and to store the copied information to a replaced first memory unit.

The image forming apparatus may further include a manipulating panel to receive an input of a user. The control unit may be configured to select one of the main memory unit and the second memory unit according to the manipulation of the user, to copy the information of the lifespan of the consumable product stored at the selected memory unit, and to store the copied information to the replaced first memory unit.

Embodiments of the present disclosure also provide an image forming apparatus configured to form a color image by having at least one consumable product, the image forming apparatus includes a main board, a first memory unit, a second memory unit and a control unit. The first memory unit may be detachably coupled to the main board. The second memory unit may be connected to the main board. The control unit may be configured to determine whether the second memory unit has been replaced, to copy information of a lifespan of the consumable product stored at a main memory of the main board or information of a lifespan of the consumable product stored at the first memory unit in the form of a backup, and to store the copied information to a replaced second memory unit.

The image forming apparatus may further include a manipulating panel to receive a manipulation input of a user. The control unit may be configured to select one of the main memory unit and the first memory unit according to the manipulation of the user, to copy the information on the lifespan of the consumable product stored at the selected memory unit, and to store the copied information to the replaced second memory unit.

Embodiments of the present disclosure also provide a method of controlling an image forming apparatus configured to form a color image by having at least one consumable product. Information of a lifespan of the consumable product may be read from a consumable product memory unit installed at the consumable product. Whether a first memory unit detachably coupled to a main board requires an updating may be determined. If it is determined that the first memory unit requires updating, the read information of the lifespan of the consumable product may be stored at the first memory unit in the form of a backup. Whether a second memory connected to the main board requires an updating may also be determined. If determined that the second memory requires updating, the read information of the lifespan of the consumable product may be stored at the second memory unit in the form of a backup. The information of the lifespan of the consumable product may be updated according to the amount of the consumption of the consumable product being used during a printing process, and the updated information of the lifespan of the consumable product may be stored to the consumable product memory unit.

In the storing at the first memory unit in the form of a backup, in a case when the read information of the lifespan of the consumable product is shorter than the information of the lifespan stored at the first memory unit in the form of a backup, the information of the lifespan of the consumable product stored at the first memory unit may be updated with the read information.

In the storing at the second memory unit in the form of a backup, in a case when the read information of the lifespan of the consumable product is shorter than the information of the lifespan stored at the second memory unit in the form of a backup, the information on the lifespan of the consumable product stored at the second memory unit may be updated with the read information.

Embodiments of the present disclosure also provide a method of controlling an image forming apparatus configured to form a color image by having at least one of consumable product, where the method is as follows. Whether a main board has been replaced may be determined. A first memory unit detachably coupled to the main board or a second memory unit connected to the main board may be selected according to a manipulation of a user. Information of a lifespan of the consumable product stored at the selected memory unit may be copied and the copied information may be stored to a replaced main board.

Embodiments of the present disclosure also provide a method of controlling an image forming apparatus configured to form a color image by having at least one of consumable product, where the method is as follows. Whether a first memory unit, which is detachably coupled to a main board, has been replaced may be determined. A main memory unit of the main board or a second memory unit connected to the main board may be selected according to a manipulation of a user. Information of a lifespan of the consumable product stored at the selected memory unit may be copied, and the copied information may be stored to a replaced first memory unit.

Embodiments of the present disclosure also provide a method of controlling an image forming apparatus configured to form a color image by having at least one consumable product, where the method is as follows. Whether a second memory unit, which is connected to a main board, has been replaced may be determined. A main memory unit of the main board or a first memory unit detachably coupled to the main board may be selected according to a manipulation of a user. Information of a lifespan of the consumable product stored at the selected memory unit may be copied, and the copied information may be stored to a replaced second memory unit.

As described above, since the information of the lifespan of the consumable product is stored at a separate memory device, which is detachably coupled to a main board, in the form of a backup, even in a case when the main board needs to be replaced due to a defect of the main board, initialization of the information of the lifespan of the consumable product may be prevented from occurring.

In addition, as a separate memory device is detached from a conventional main board to mount the separate memory device on a replaced main board, a convenience is achieved during the replacement task of the main board.

In addition, since the information on the consumable product is stored at a plurality of memory devices, even in a case when a certain one of the plurality of memory devices is hacked, the information on the lifespan of the consumable product may be effectively managed.

BRIEF DESCRIPTION OF THE DRAWINGS

These and/or other features and utilities of the present general inventive concept will become apparent and more readily appreciated from the following description of the embodiments, taken in conjunction with the accompanying drawings of which:

FIG. 8 is a drawing schematically illustrating the information on the lifespan of a consumable product in accordance with an embodiment of the present disclosure.

DETAILED DESCRIPTION OF THE PREFERRED EMBODIMENTS

Figure 1:
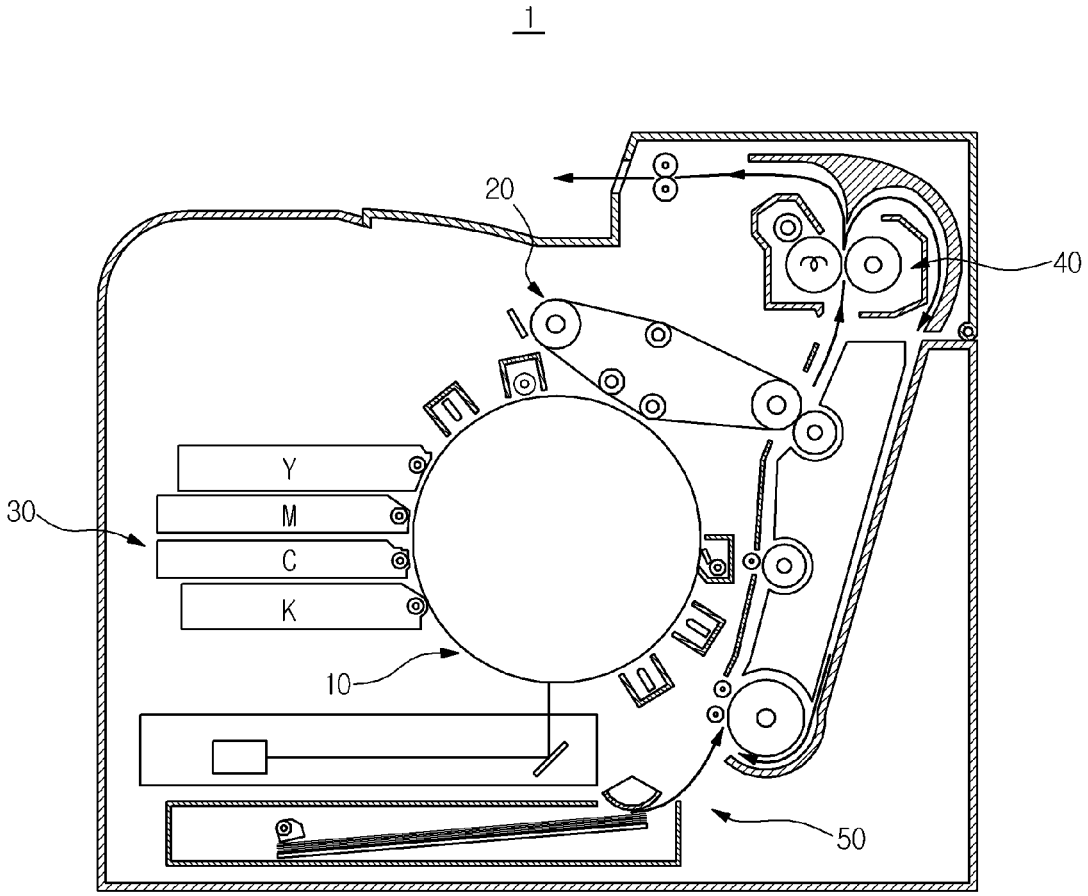
FIG. 1 is a side cross-sectional view schematically illustrating an engine structure of an image forming apparatus in accordance with an embodiment of the present disclosure.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

FIG. 1 is a side cross-sectional view schematically illustrating an engine structure of an image forming apparatus in accordance with an embodiment of the present disclosure.

Referring to FIG. 1, an image forming apparatus 1 using an electro-photographing method includes a photosensitive unit 10, a developing unit 30, an intermediate transfer unit 20, a fixing unit 40, and a pick-up unit 50.

The photosensitive unit 10 includes a photosensitive medium, and the photosensitive medium is referred to as a photosensitive drum 11 formed of a cylindrical metallic drum and having a conductive layer on an outer circumferential surface thereof. Hereinafter, in the embodiments to be described, the photosensitive drum 11 will be used as the photosensitive medium.

In addition, at the surroundings of the photosensitive drum 11, a charging unit configured to electrically charge the outer circumferential surface of the photosensitive drum 11 with uniform electric potential, a pre-transfer electrical charge removing unit configured to remove the electric charge from the photosensitive drum 11 other than the portion of the outer circumferential surface of the photosensitive drum 11 on which a toner image is formed, a photosensitive drum cleaning unit configured to remove waste toner that remains at the photosensitive drum 11, and a pre-charging electrical charge removing unit configured to remove the electrical charge from the outer circumferential surface of the photosensitive drum 11.

The developing unit 30 includes a plurality of cartridges 31, 33, 35, and 37 configured to accommodate colors that are different from each other. As one example, the plurality of cartridges 31, 33, 35, and 37 may accommodate the toners having the form of a solid powder that are provided with yellow "Y', cyan 'C', magenta 'M', and black 'B', respectively. The plurality of cartridges 31, 33, 35, and 37 are sequentially disposed in a rotating direction while facing the photosensitive drum 11. In addition, the plurality of cartridges 31, 33, 35, and 37 each is provided with a developing roller configured to supply a toner at the electrostatic latent image formed at the outer circumferential surface of the photosensitive drum 11 to form a toner image from the electrostatic latent image.

The intermediate transfer unit 20 includes an intermediate transfer belt 21 and a plurality of supporting rollers that is configured to support and rotate the intermediate transfer belt 21. The intermediate transfer belt 21 is disposed while facing the photosensitive drum 11, and the toner image formed on the outer circumferential surface of the photosensitive drum 11 is intermediately transferred at the intermediate transfer belt 21. In addition, the intermediate transfer unit 20 is provided with a cleaning member configured to remove a waste toner that remains at the intermediate transfer belt 21 after the toner image is ultimately transferred on a printing medium.

The fixing unit 40 includes a heating roller configured to generate heat, and a pressing roller configured to press a printing medium while facing the heating roller in the course of rotating at a predetermined pressure. In addition, by applying heat and pressure on the toner image that is ultimately transferred on a printing medium, the toner image is placed on the printing medium in a heat-fused manner.

The pick-up unit 50 includes a paper feeding cassette configured to load a printing medium and detachably installed at a body of the image forming apparatus, and a pick-up roller installed at an upper side of the paper feeding cassette to pick up the printing medium one sheet of the printing medium at a time.

A transfer roller is installed in a way to make contact with or be spaced apart from the intermediate transfer belt 21, while facing the intermediate transfer belt 21. The transfer roller, when an ultimate transfer is not taking place, is spaced apart from the intermediate transfer belt 21, and when an ultimate transfer is taking place, the transfer roller makes contact with the intermediate transfer belt 21 at a predetermined pressure, and transfers the toner image that is intermediately transferred at the intermediate transfer belt 21 on a printing medium.

As such, the image forming apparatus using an electrophotographing method is required to be provided with various consumable products to form a color image. The consumable product includes the photosensitive drum 11, the plurality of developing cartridges 31, 33, 35, and 37, the intermediate transfer belt 21, the fixing unit 40, and the pick-up unit 50.

The control system of the image forming apparatus 1 is configured to manage the information with reference to the lifespan of the consumable product, and for such, at a main memory unit 62 of a main board 60, the information with reference to the lifespan of the consumable product is stored. Here, the information on the lifespan of the consumable product, which is stored at the main memory unit 62, refers to the information of the consumable product that is read from consumable product memory units 12, 22, 32, 34, 36, 38, 42, and 52, which are installed at each respective consumable product.

Meanwhile, in a case when the main board 60 is replaced as a defect is generated at the main board 60, the information on the lifespan of the consumable product, which is stored at the main memory unit 62, is lost, and a process of restoring the information on the lifespan of the consumable product at the main memory unit 62 of the replaced main board 62 is required. As such, an action to store the information on the lifespan of the consumable product to a different memory device in the form of a backup, and an action to store the information on the lifespan of the consumable product to the main memory unit 62 of the replaced main board 60 by copying from the different memory device is required. Hereinafter, a method of storing the information on the lifespan of the consumable product in accordance with an embodiment of the present disclosure will be described in detail.

Figure 2:
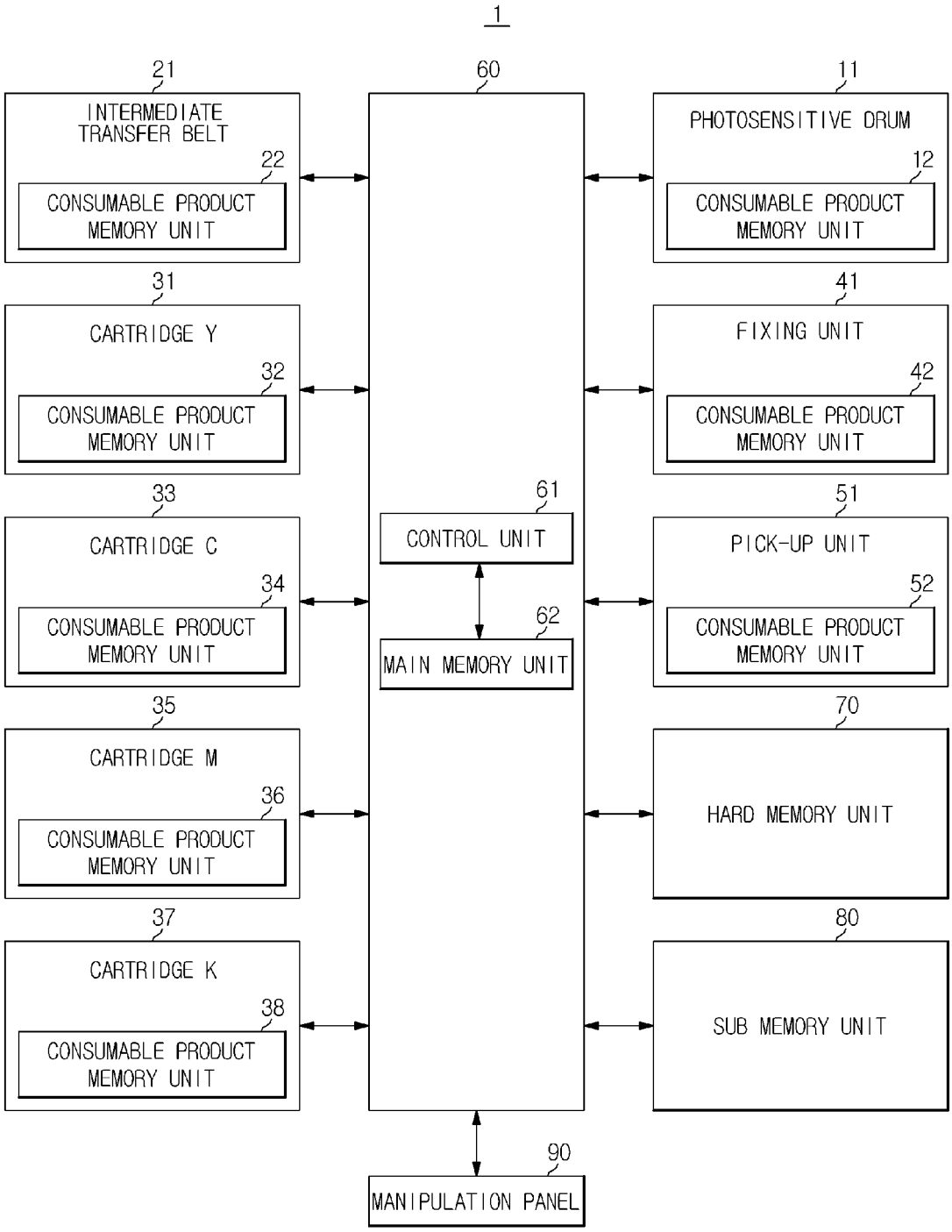
FIG. 2 is a block diagram schematically illustrating a control structure of an image forming apparatus in accordance with an embodiment of the present disclosure.

FIG. 2 is a blocked diagram schematically illustrating a control structure of an image forming apparatus in accordance with an embodiment of the present disclosure.

Referring to FIG. 2, the image forming apparatus 1 includes the main board 60, the plurality of consumable product 11, 21, 31, 33, 35, 37, 41, and 51, a hard memory unit 70, a sub memory unit 80, and a manipulating panel 90.

The main board 60 includes a control unit 61 configured to control the overall operations of the image forming apparatus 1, and the main memory unit 62 at which various control programs and the data being generated from the execution of various control programs are stored.

The control unit 61 is configured to determine if the operation state of the image forming apparatus 1 is normal or abnormal. When the power of the image forming apparatus 1 is turned ON, the control unit 61, according to the control program, performs the initializing operation of the image forming apparatus 1. At this time, the control unit 61 inspects the various memory units 62, 70, and 80, and as well as I/O (input/output) apparatuses. In a case when a defect is generated at the various memory units 62, 70, and 80, and the I/O (input/output) apparatuses, the control unit 61 determines the image forming apparatus 1 to be in the abnormal operation state, and performs an operation according to a diagnosis program. Meanwhile, in a case when a defect is not generated, the control unit 61 determines the image forming apparatus 1 to be in the normal operation state, and enables the image forming apparatus 1 to enter a standby mode, or a printing mode according to the manipulation of a user.

In addition, the control unit 61, by using an interface that is installed at the various consumable products, exchanges various data with the consumable product memory units 12, 22, 32, 34, 36, 38, 42, and 52. For example, the control unit 61 may read the information on the lifespan of the intermediate transfer belt 21 from the consumable product memory unit 22 installed at the intermediate transfer belt 21. The control unit 61, by analyzing the information on the lifespan that is read, may determine if the lifespan of the intermediate transfer belt 21 is completed. For such, the lifespan of the various consumable products may be stored at the main memory unit 62, or the information on whether the lifespan of the consumable products is completed may be stored to the consumable product memory units 12, 22, 32, 34, 36, 38, 42, and 52 of the various consumable products.

Meanwhile, the control unit 61 calculates the amount of the consumption of the consumable product that is used during the printing operation of the image forming apparatus 1. The control unit 61 may calculate the amount of the consumption of the various consumable products while the printing operation of the image forming apparatus 1 is taking place, or the control unit 61 may calculate the amount of the consumption of the various consumable products after the printing operation of the image forming apparatus 1 is completed. The control unit 61 generates the information on the lifespan of the consumable product that is updated according to the calculated amount of the consumption of the various consumable products, and stores the updated information on the lifespan of the consumable product to the consumable product memory units 12, 22, 32, 34, 36, 38, 42, and 52 of the various consumable product. Meanwhile, as for a method to calculate the amount of the consumption of the consumable product, various methods according to conventional technology may be adopted.

As one example, the control unit 61, as to calculate the amount of the consumption of the developing cartridges 31, 33, 35, and 37, reads the information on the remaining amount of the toners of the cartridges at a present time from the consumable product memory units 32, 34, 36, and 38. Then, the control unit 61 calculates the amount of the toners that are consumed during the printing operation of the image forming apparatus 1. Here, the amount of the toners being consumed may vary depending on, for example, the resolution and the size of the color image. The control unit 61, by subtracting the calculated amount of consumption of the toners from the remaining amount of the toners, may calculate the updated amount of the remaining toners.

As an another example, the control unit 61, in order to calculate the amount of the consumption of the photosensitive drum 11, may use the time of the operation of the driving motor that rotates the photosensitive drum 11. In general, the usage frequency of the photosensitive drum 11 is limited because all of the waste toner is not collected in the process of removing the waste toner that remains at the photosensitive drum 11. Thus, the control unit 61, through the amount of the rotation of the photosensitive drum 11, may calculate the amount of the consumption of the photosensitive drum 11.

The main memory unit 62 refers to a main memory of the main board 60, and includes a volatile memory device and a non-volatile memory device. The data at the non-volatile memory device, even when the power of the image forming apparatus 1 is turned OFF, is not lost, and as to update and store various data, an EEPROM or a flash memory device may be used.

Meanwhile, the various control programs, not only at the non-volatile memory device, may be stored at the hard memory unit 70. When the power of the image forming apparatus 1 is turned ON, the various control programs are copied at the volatile memory device. For such, a SODIMM (small outline dual in-line memory module) memory device may be used as the volatile memory device. The control unit 61, according to the control program that is copied at the volatile memory device, controls the operation of the image forming apparatus 1.

The plurality of consumable products may include the photosensitive drum 11, the cartridge Y 31, the cartridge C 33, the cartridge M 35, the cartridge K 37, the intermediate transfer belt 21, and fixing unit 41, and the pick-up unit 51. At the various consumable products, each of the memory units 12, 22, 32, 34, 36, 38, 42, and 52 is installed, and the information on the lifespan of the consumable product is stored at each of the memory units 12, 22, 32, 34, 36, 38, 42, and 52. At this time, not only the information with reference to the lifespan of the consumable product, but information such as the name, the serial number, and the supplier may be stored together. The information as such may be used when the control program configures the authenticity of the consumable product. As for the information with reference to the lifespan of the consumable product, the capacity and the remaining amount of the consumable product are included.

The hard memory unit 70 is a subsidiary memory device of the main board 60, and in general, at the hard memory unit 70, image data for the spooling process is temporarily stored. Meanwhile, in the present embodiment of the disclosure, at the hard memory 70, the information on the lifespan of the various consumable products may be stored in the form of a backup.

The hard memory 70 may be connected to the main board 60 via a cable. Accordingly, a user may replace the hard memory unit 70 by easily separating the hard memory 70 from the main board 60. The hard memory unit 70, on the basis of the SATA (Serial Advanced Technology Attachment) bus interface, receives/transmits data from/to the main board 60.

The sub memory unit 80 is a backup memory of the main board 60, and information of the lifespan of the various consumable products is stored in the form of a backup at the sub memory 80. The sub memory unit 80 may be coupled to the main board 60 by use of a connector in an attachable/detachable manner. Accordingly, a user may replace the sub memory unit 80 by easily separating the sub memory unit 80 from the main board 60.

The sub memory unit 80 may include at least one memory device. As one example, at a single memory device having a large memory capacity, the information of the lifespan of the various consumable products and the system information of the image forming apparatus 1 may be stored. As another example, the sub memory unit 80 may include a memory device configured to store the information of the lifespan of the various consumable products, and a memory device configured to store the system information of the image forming apparatus 1.

The information of the lifespan of the various consumable products stored at the hard memory unit 70 and at the sub memory unit 80 may be encrypted, or may be stored in the form of a compressed file.

Meanwhile, the consumable product memory units 12, 22, 32, 34, 36, 38, 42, and 52, as well as the sub memory unit 80, on the basis of the 120 (inter Integrated Circuit) bus interface, receives/transmits data from/to the main board 60. At this time, the 12C bus interface may receive/transmit the two-direction signals of the serial data (SDA) signal and the serial clock (SCL) signal. Accordingly, the number of signal lines, which are connected in between the consumable product memory units 12, 22, 32, 34, 36, 38, 42, and 52, the sub memory unit 80 and the main board 60, is reduced, and thus a simple structure of the system of the image forming apparatus 1 may be achieved.

In addition, the consumable product memory units 12, 22, 32, 34, 36, 38, 42, and 52, and the sub memory unit 80 may use a certification protocol of authenticity at the I2C bus interface in order to prevent hacking from occurring. As for an encryption method of the protocol, a traditional encryption method may be used, and various methods by the conventional technology may be adopted.

In order to store the updated information of the lifespan of the consumable product to the various memory units 62, 70, and 80, the controller 61 compares the information of the lifespan of the consumable product, which is read from the consumable product memory units 12, 22, 32, 34, 36, 38, 42, and 52, with the information of the lifespan of the consumable product which is stored at the various memory units 62, 70, and 80.

The control unit 61 may be able to analyze the name, the serial number, and the supplier of the consumable product, which is included in the lifespan information of the consumable product, and the lifespan information of the consumable product, which is read, may be determined as the valid data only when the change has occurred only on the information of the lifespan of the consumable product, while the information on the name, the serial number, and the supplier of the consumable product is the same.

In addition, the control unit 61 may be able to analyze the information with reference to the lifespan of the consumable product. The control unit 61, in a case when the read information on the lifespan of the consumable product is further shortened with respect to the information of the lifespan of the consumable product stored at the various memory units 62, 70, and 80, may determine that the lifespan information of the consumable product, which is read, is valid.

The control unit 61 then stores the information of the lifespan of the valid consumable product to the various memory units 62, 70, and 80. Accordingly, at the various memory units 62, 70, and 80, storing information of the extended lifespan of the consumable product is limited if the extended life span is larger than the information of the pre-stored lifespan of the consumable product.

In addition, as described above, the information of the lifespan of the consumable product, not only at the main memory unit 62, is stored at the hard memory unit 70 and at the sub memory unit 80 in the form of a backup. Thus, even in a case when one of the main memory unit 62, the hard memory unit 70, and the sub memory unit 80 is determined to be compromised as a result of hacking, etc., the control unit 61, through the information of the lifespan of the consumable product that is stored at the remaining memory units, may be able to determine whether the replaced consumable product is genuine.

The manipulation panel 90 is provided with an input for a user. As such, the manipulation panel 90 may include a click button or a touch panel that is provided at the body of the image forming apparatus 1. In the alternative, a user may input a command by manipulating a terminal that is connected through a USB port of the image forming apparatus 1 or through a network that is connected to the image forming apparatus 1.

In addition, the manipulation panel 90 may display information being processed according to the manipulation of the user. As such, the manipulation panel 90 may be provided with a display unit. Meanwhile, the menu or the configuration of the message being displayed through the manipulation panel 90 may be adopted with various methods, such as a method of using icons, of a conventional technology.

Figure 3:
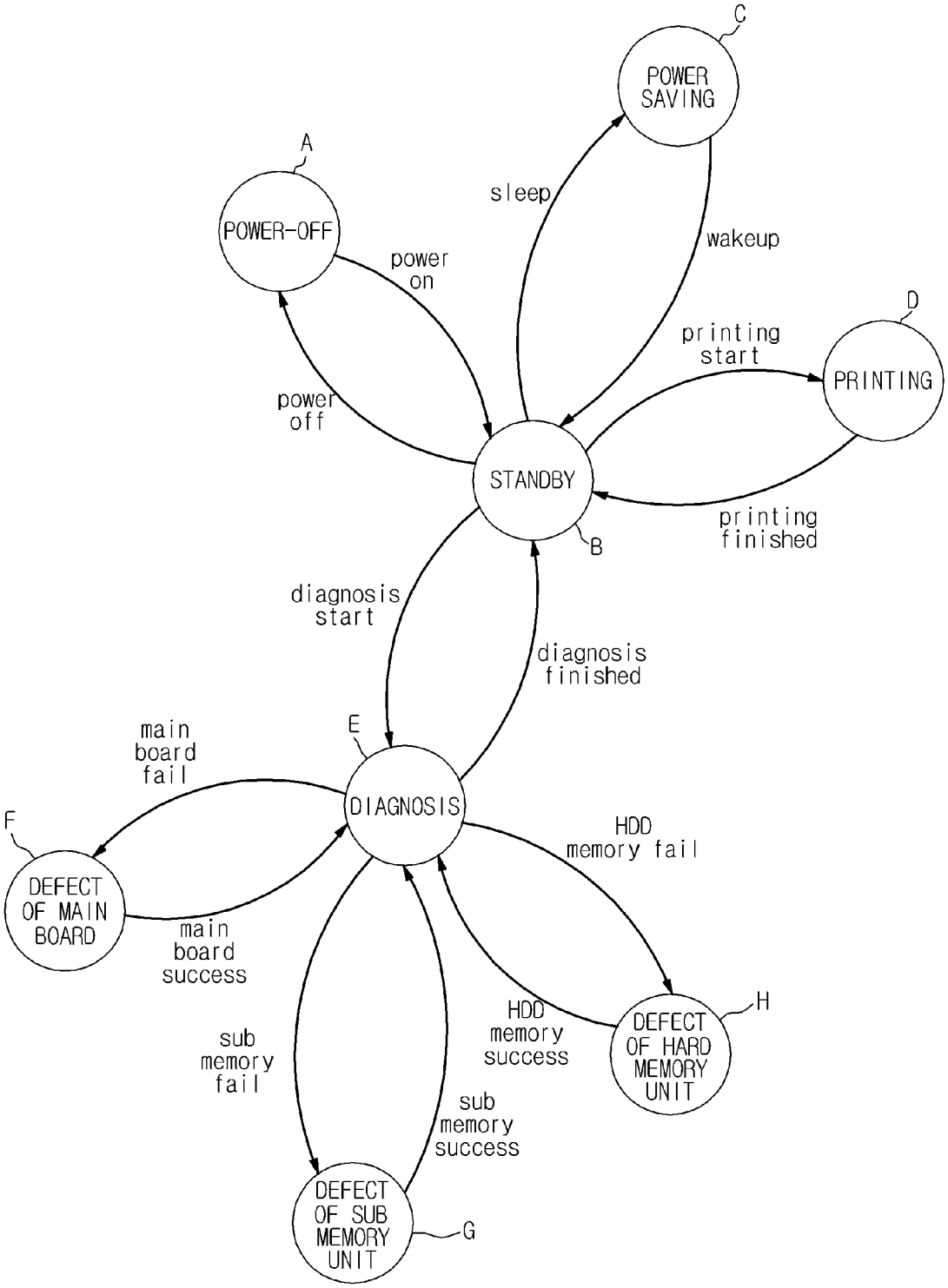
FIG. 3 is a state diagram schematically illustrating a state mode of an image forming apparatus in accordance with an embodiment of the present disclosure.

FIG. 3 is a state diagram schematically illustrating a state mode of an image forming apparatus in accordance with an embodiment of the present disclosure.

Referring to FIG. 3, as for the state modes of the image forming apparatus 1, a power OFF mode, a standby mode, a power saving mode, a printing mode, and a diagnosis mode are present.

Since the descriptions with reference to the power OFF mode, the standby mode, the power saving mode, the printing mode, and the diagnosis mode are considered as general with respect to the various state modes of the image forming apparatus 1, the detailed descriptions of the above will be omitted in the embodiments of the present disclosure.

The image forming apparatus 1 enters the diagnosis mode from the standby mode in order to inspect a defect of the image forming apparatus 1. At this time, the image forming apparatus 1 may enter the diagnosis mode by automatically determining defects of the various components, or may enter the diagnosis mode by the manipulation of a user through the manipulation panel 90. Here, as for the type of a defect, a defect of the main board 60, a defect of the sub memory unit 80, or a defect of the hard memory unit 70 may be present. According to the various types of the defects, a user (a service technician) proceeds with replacing each component, and with respect to each component that is replaced, a copying process of the information of the lifespan of the consumable product, which will be described later, is performed.

Figure 4:
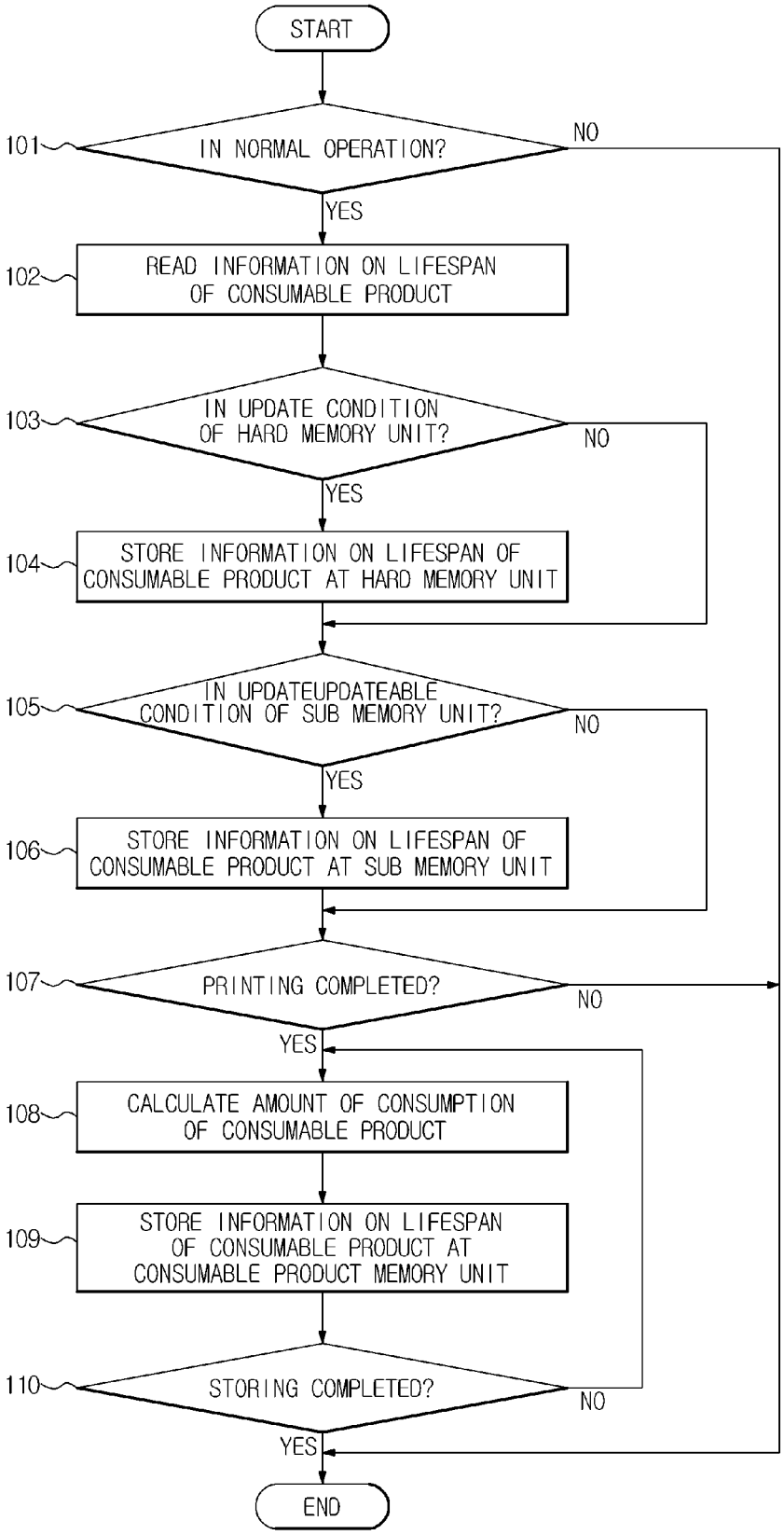
FIG. 4 is a flow chart schematically illustrating a backup method of the information on the lifespan of a consumable product in accordance with an embodiment of the present disclosure.

FIG. 4 is a flow chart schematically illustrating a backup method of the information on the lifespan of a consumable product in accordance with an embodiment of the present disclosure.

Referring to FIG. 4, the control unit 61 determines if the image forming apparatus 1 is in a state of a normal operation (operation 101). Here, the state of a normal operation is referred to as a state of the image forming apparatus 1 entering the standby mode or the printing mode after the initializing operation takes place. Thus, the backup operation of the information on the lifespan of the consumable product, which will be described hereinafter, takes place in the standby state or in the printing state of the image forming apparatus 1.

Next, the control unit 61, when the image forming apparatus 1 is in the state of a normal operation, reads the information of the lifespan of the consumable product from the consumable product memory unit (operation 102). The information of the lifespan of the consumable product that is read from the consumable product memory unit is temporarily stored to the main memory unit 62.

Next, the control unit 61 determines whether the hard memory unit 70 requires updating (operation 103). That is, the control unit 61 determines whether the information of the lifespan of the consumable product, which is stored at the hard memory unit 70, needs to be updated. Here, the condition of the hard memory unit 70 requiring updating refers to a case when the information of the lifespan of the consumable product, which is read from the consumable product memory unit, is not the same as the information of the lifespan of the consumable product which is stored at the hard memory unit 70. In addition, the control unit 61 may determine whether the information of the lifespan of the consumable product is valid data.

Next, if it is determined that the hard memory unit 70 requires updating, the control unit 61 stores the information of the lifespan of the consumable product, which is read from the consumable product memory unit, to the hard memory unit 70 in the form of a backup (operation 104). At this time, the control unit 61 may store the information of the lifespan of all the consumable products, which is read from the consumable product memory unit, as a whole, or the control unit 61 may separately store the information of the lifespan of the consumable product, which is read from the consumable product memory unit having a change.

Next, the control unit 61 determines whether the sub memory unit 80 requires updating (operation 105). That is, the control unit 61 determines whether the information of the lifespan of the consumable product, which is stored at the sub memory unit 80, needs to be updated. Here, the condition where the sub memory unit 80 requires updating refers to a case when the information of the lifespan of the consumable product, which is read from the consumable product memory unit, is not the same as the information of the lifespan of the consumable product which is stored at the subsidiary memory unit 80.

Next, if it is determined that the sub memory unit 80 requires updating, the control unit 61 stores the information of the lifespan of the consumable product, which is read from the consumable product memory unit, at the sub memory unit 80 in the form of a backup (operation 106). At this time, the control unit 61 may store the information of the lifespan of all the consumable products, which is read from the corresponding consumable product memory unit, as a whole, or the control unit 61 may separately store the information of the lifespan of the consumable product, which is read from the consumable product memory unit having a change.

Next, the control unit 61 determines whether the image forming apparatus 1 is in a state of a completion of a printing (operation 107). In a case when the image forming apparatus 1 is still in the process of printing or is at the standby mode from the start, the control unit 61 completes the backup process of the information on the lifespan of the consumable product.

In a case of a state of a completion of a printing, the control unit 61 calculates the amount of the consumption of the consumable product that is being used during the printing operation (operation 108). The control unit 61, according to the calculated amount of the consumption of the consumable product, generates the updated information of the lifespan of the consumable product, and stores the updated information of the lifespan of the consumable product to the consumable product memory unit (operation 109). At this time, the control unit 61 may store the information of the lifespan of all the consumable products as a whole, or may separately store the information of the lifespan of the consumable product having an update. Next, the control unit 61 determines whether the storing of the information of the lifespan of the consumable product is completed (operation 110). When all the information of the lifespan of the consumable product is stored, the control unit 61 completes the backup operation of the information of the lifespan of the consumable product. However, if all the information of the lifespan of the consumable product is not stored, the control unit 61 repeats the operation of calculating the amount of the consumption of the consumable product and of storing the information of the lifespan of the consumable product.

Figure 5:
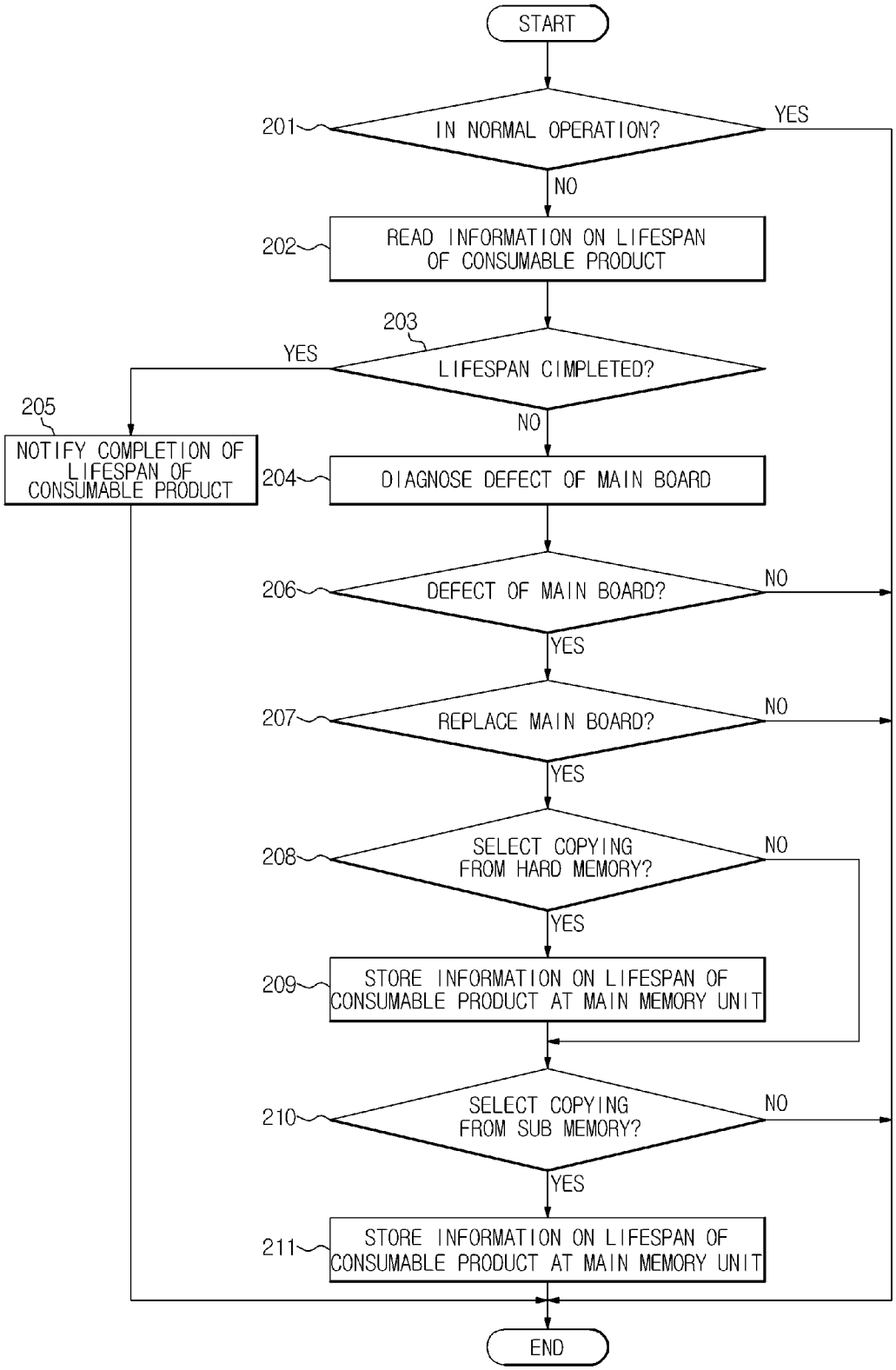
FIG. 5 is a flow chart schematically illustrating a copying method of the information on the lifespan of a consumable product in accordance with an embodiment of the present disclosure.

FIG. 5 is a flow chart schematically illustrating a copying method of the information of the lifespan of a consumable product in accordance with an embodiment of the present disclosure.

Referring to FIG. 5, the control unit 61 determines if the image forming apparatus 1 is in a state of a normal operation (operation 201). Here, the state of a normal operation, as described above, is referred to as the state where the image forming apparatus 1 enters the standby mode or the printing mode. In a case when the image forming apparatus 1 is in the state of an abnormal operation, the control unit 61 performs the backup operation of the information of the lifespan of the consumable product according to the diagnosis program, which will be described hereinafter.

Next, when the image forming apparatus 1 is in the state of an abnormal operation, the control unit 61 reads the information of the lifespan of the consumable product from the consumable product memory unit (operation 202). The information of the lifespan of the consumable product that is read from the consumable product memory unit is then temporarily stored to the main memory unit 62.

Next, the control unit 61 determines whether the lifespan of the consumable product is completed (operation 203). In a case when the lifespan of the consumable product is completed, the control unit 61 notifies a user that the lifespan of the consumable product is completed (operation 205). At this time, the control unit 61 can allow a message stating that the lifespan of the consumable product is completed to be output along with the name of the consumable product at the manipulation panel 90.

The control unit 61, after determining that the lifespan of the consumable product is not completed, performs a diagnosis on the defect of the main board 60 (operation 204). According to the diagnosis result, the control unit 61 determines whether the cause of the state of an abnormal operation is the result of a defect of the main board 60 (operation 206). At this time, the control unit 61 may provide a message to be output at the manipulation panel 90 stating the defect of the main board 60.

Next, the control unit 61 determines whether the main board 60 has been replaced (operation 207). In general, in a case when the cause of the state of an abnormal operation of the image forming apparatus 1 is the result of a defect of the main board 60, the defect of the hard memory unit 70, or the defect of the sub memory unit 80, the main board 60, the hard memory unit 70, or the sub memory unit 80 causing the defect is replaced by a user (a service technician). At this time, the control unit 61 can allow a message, which inquires as to whether a replacement of the main board 60 has occurred, to be output at the manipulation panel 90. As a user (a service technician) selects a menu checking the replacement of the main board 60 by manipulating the manipulation panel 90, the control unit 61 may determine that the main board 60 has been replaced. In other words, the manipulation by a user provides a response to the inquiry by the control unit 61.

Next, the control unit 61 determines whether the information of the lifespan of the consumable product is to be copied from the hard memory unit 70 to the main memory unit 62 of the replaced main board 60 (operation 208). At this time, the control unit 61 can provide a message requesting to select the hard memory unit 70 or the sub memory unit 80 to be output at the manipulation panel 90 as the memory to be copied to the main memory unit 62. When the hard memory unit 70 is selected according to the manipulation of a user, the control unit 61 copies the information of the lifespan of the consumable product, which is stored at the hard memory unit 70, and stores the copied information to the main memory unit 62 of the replaced main board 60 (operation 209).

Next, the control unit 61 determines whether the information of the lifespan of the consumable product is to be copied from the sub memory unit 80 to the main memory unit 62 of the replaced main board 60 (operation 210). When the subsidiary memory unit 80 is selected according to the manipulation of a user, the control unit 61 copies the information of the lifespan of the consumable product, which is stored at the sub memory unit 80, and stores the copied information to the main memory unit 62 of the replaced main board 60 (operation 211).

Meanwhile, the control unit 61 can allow the information of the lifespan of the consumable product to be copied to the main memory unit 62 of the replaced main board 60 only in a case when the information of the lifespan of the consumable product, which is stored at the hard memory unit 70, is same as the information of the lifespan of the consumable product stored at the sub memory unit 80. Accordingly, in a case when one of the hard memory unit 70 and the sub memory unit 80 has been compromised as a result of hacking, etc., and thus the information of the lifespan of the consumable product stored at the hard memory unit 70 and the information of the lifespan of the consumable product stored at the sub memory unit 80 are different from each other, the control unit 61 may be able to stop the operation of the image forming apparatus 1.

Figure 6:
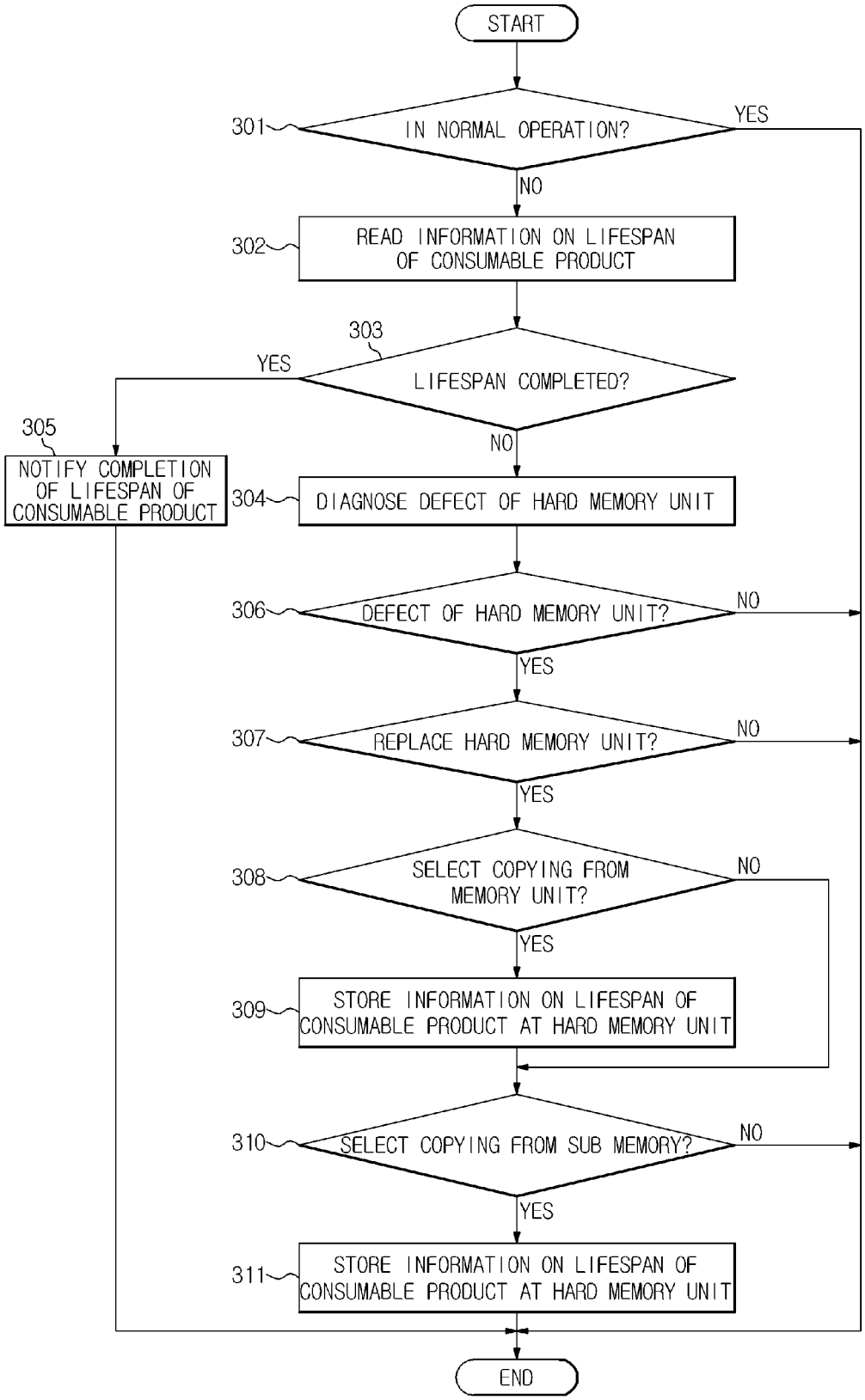
FIG. 6 is a flow chart schematically illustrating a copying method of the information on the lifespan of a consumable product in accordance with another embodiment of the present disclosure.

FIG. 6 is a flow chart schematically illustrating a copying method of the information of the lifespan of a consumable product in accordance with another exemplary embodiment of the present disclosure.

Referring to FIG. 6, unless the lifespan of the consumable product is determined to be completed, the control unit 61 performs a diagnosis with respect to defects of the hard memory unit 70 according to the diagnosis program (operation 304). According to the diagnosis result, the control unit 61 determines whether the cause of the state of an abnormal operation of the image forming apparatus 1 is the result of a defect of the hard memory unit 70 (operation 306). At this time, the control unit 61 can provide a message informing about the defect of the hard memory unit 70 to be output at the manipulation panel 90.

Next, the control unit 61 determines whether the hard memory unit 70 has been replaced (operation 307). At this time, the control unit 61 can provide a message inquiring as to whether a replacement of the hard memory unit 70 has occurred, to be output at the manipulation panel 90. As a user (a service technician) selects the menu checking the replacement of the hard memory unit 70 by manipulating the manipulation panel 90 (responding to the inquiry by the control unit 61), the control unit 61 can determine that the hard memory unit 70 has been replaced.

Next, the control unit 61 determines whether the information of the lifespan of the consumable product is to be copied to the replaced hard memory unit 70 from the main memory unit 62 (operation 308). At this time, the control unit 61 can provide a message to select the main memory unit 62 or the sub memory unit 80 to be output at the manipulation panel 90. When the main memory unit 62 is selected according to the manipulation of a user as a result of the message by the control unit 61, the control unit 61 copies the information of the lifespan of the consumable product, which is stored at the main memory unit 62, and stores the copied information to the replaced hard memory unit 70 (operation 309).

Next, the control unit 61 can provide a message to determine whether the information of the lifespan of the consumable product is to be copied to the replaced hard memory unit 70 from the sub memory unit 80 (operation 310). When the subsidiary memory unit 80 is selected according to the manipulation of a user, the control unit 61 copies the information of the lifespan of the consumable product, which is stored at the sub memory unit 80, and stores the copied information to the hard memory unit 70 (operation 311).

Figure 7:
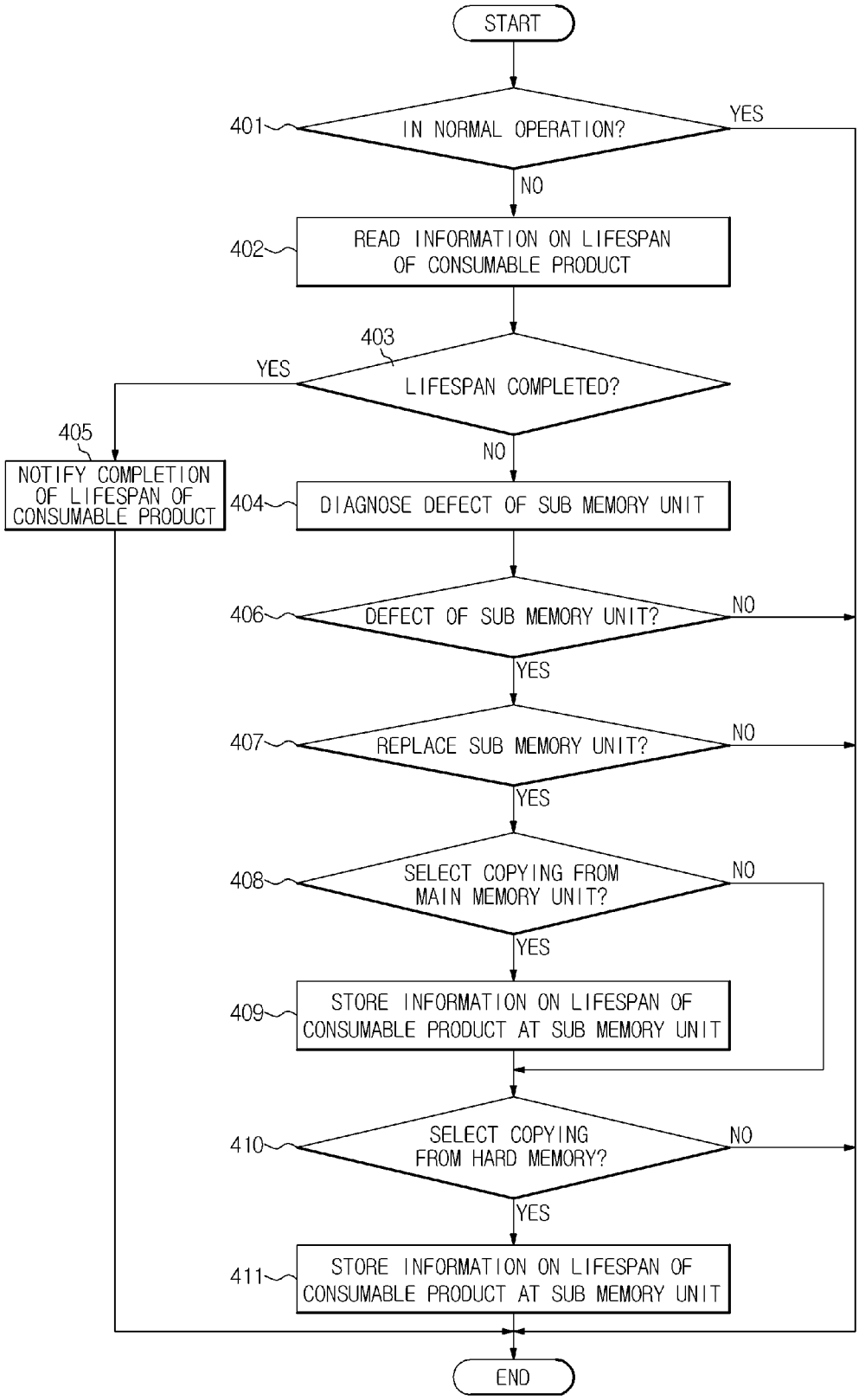
FIG. 7 is a flow chart schematically illustrating a copying method of the information on the lifespan of a consumable product in accordance with still another embodiment of the present disclosure.

FIG. 7 is a flow chart schematically illustrating a copying method of the information of the lifespan of a consumable product in accordance with still another exemplary embodiment of the present disclosure.

Referring to FIG. 7, unless the lifespan of the consumable product is determined to be completed, the control unit 61 performs a diagnosis for defects of the sub memory unit 80 according to the diagnosis program (operation 404). According to the diagnosis result, the control unit 61 determines whether the cause of the state of an abnormal operation of the image forming apparatus 1 is a result of a defect of the sub memory unit 80 (operation 406). At this time, the control unit 61 can provide a message informing about the defect of the sub memory unit 80 to be output at the manipulation panel 90.

Next, the control unit 61 determines whether the sub memory unit 80 has been replaced (operation 407). At this time, the control unit 61 can provide a message that inquires as to whether a replacement of the sub memory unit 80 has taken place to be output at the manipulation panel 90. As a user (a service technician) selects the menu checking the replacement of the sub memory unit 80 by manipulating the manipulation panel 90 (in response to the inquiry by the control unit 61), the control unit 61 can determine whether the sub memory unit 80 has been replaced.

Next, the control unit 61 determines whether the information of the lifespan of the consumable product is to be copied to the replaced sub memory unit 80 from the main memory unit 62 (operation 408). At this time, the control unit 61 can provide a message to select the main memory unit 62 or the hard memory unit 70 to be output at the manipulation panel 90. When the main memory unit 62 is selected according to a manipulation of a user in response to the message, the control unit 61 copies the information of the lifespan of the consumable product, which is stored at the main memory unit 62, and stores the copied information to the replaced sub memory unit 80 (operation 409).

Next, the control unit 61 determines whether the information of the lifespan of the consumable product is to be copied to the replaced sub memory unit 80 from the hard memory unit 70 (operation 410). When the hard memory unit 70 is selected according to a manipulation of a user, the control unit 61 copies the information of the lifespan of the consumable product, which is stored at the hard memory unit 70, and stores the copied information to the sub memory unit 80 (operation 411).

Meanwhile, different from the description provided above with respect to FIGS. 5 to 7, in another exemplary embodiment, a user does not select from which memory unit the information of the lifespan of the consumable product is to be copied, and the control unit 61 may automatically perform the copying operation of the information of the lifespan of the consumable product according to the diagnosis program. At this time, the control unit 61, by analyzing the information with respect to the name, the serial number, or the supplier of the main board 60, the hard memory unit 70, or the sub memory unit 80, automatically determines whether the replacement is needed to be made. Then, according to a priority order that is determined in advance, the control unit 61 selects from which memory unit the information of the lifespan of the consumable product is to be copied. In addition, even in a case when no selection is made by a user during a period of a reference time, the selection may be made by the same method.

FIG. 8 is a drawing schematically illustrating the information of the lifespan of a consumable product in accordance with an embodiment of the present disclosure.

Referring to FIG. 8, the information of the lifespan of the consumable product that is stored at the each memory unit may include the system information and the information of the lifespan of the various consumable products of the image forming apparatus 1.

As for the system information of the image forming apparatus 1, the information of the firmware version of the main board 60, the total page, the total image, or the counts of the platen scan pages may be included. The control unit 61, based on the amount of the printed pages, the amount of the printed images, or the amount of the scanned pages, may increase the counts.

As for the information of the lifespan of the various consumable products, the information of the fixing unit, the transfer roller, a tray roller, or the intermediate transfer belt may be included based on the image or the page. Here, the information on the lifespan of the transfer roller and the tray roller is related to the information on the lifespan of the pick-up unit.

Meanwhile, the information on the lifespan of the developing cartridges may be provided based on the remaining amount of the toner and the number of the counts. In addition, as already described above, other than the information on the lifespan of the consumable product, the information such as the serial number, the supplier, the product date, the last used date, and the first installed date may be included in the information on the lifespan of the various consumable products.

Meanwhile, according to the manipulation of a user, the information on the lifespan of the consumable product as described above may be displayed on a manipulation panel. Accordingly, a user may be able to easily check the information of the lifespan of the consumable product, and by managing the lifespan of the consumable product, the consumable product may be replaced at a proper time.

Meanwhile, the exemplary embodiments are not limited to only being applied to a color image forming apparatus, but may also be adopted with respect to a mono image forming apparatus.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An image forming apparatus comprising:

a main board;

a first memory unit detachably coupled to the main board; and a control unit configured to read the information of the lifespan of a consumable product from a consumable product memory unit installed at the consumable product and to store the read information of the lifespan of the consumable product to the first memory unit in the form of a backup, wherein when the read information of the lifespan of the consumable product from the consumable product memory unit is shorter than the information of the lifespan of the consumable product stored at the first memory unit in the form of a backup, the control unit is configured to determine whether the read information of the lifespan of the consumable product from the consumable product memory unit is valid.

2. The image forming apparatus of claim 1, further comprising:

a second memory unit connected to the main board, wherein the control unit is configured to store the read information on the lifespan of the consumable product to the second memory unit in the form of a backup.

3. The image forming apparatus of claim 2, wherein:

in a case when the read information of the lifespan of the consumable product is shorter than the information of the lifespan of the consumable product stored at the second memory unit in the form of a backup, the control unit is configured to determine whether the read information of the lifespan of the consumable product is valid.

4. The image forming apparatus of claim 3, wherein:

if determined that the read information of the lifespan of the consumable product is valid, the control unit is configured to update the information of the consumable product stored at the first memory unit or at the second memory unit.

5. The image forming apparatus of claim 4, wherein:

the control unit is configured to store the read information of the lifespan of the consumable product in an encrypted manner.

6. An image forming apparatus comprising:

a main board;

a first memory unit detachably coupled to the main board;

a second memory unit connected to the main board;

and a control unit configured to read the information on the lifespan of a consumable product from a consumable product memory unit installed at the consumable product, to store the read information on the lifespan of the consumable product at the first memory unit in the form of a backup, and store the read information on the lifespan of the consumable product to the second memory unit in the form of a second backup, wherein when the read information on the lifespan of the consumable product from the consumable product memory unit is shorter than the information on the lifespan of the consumable product stored at the first memory unit in the form of a backup, the control unit is configured to store the read information on the lifespan of the consumable product from the consumable product memory unit to the first memory unit after updating the information on the lifespan of the consumable product.

7. The image forming apparatus of claim 6, wherein:

in a case when the read information on the lifespan of the consumable product is shorter than the information on the lifespan of the consumable product stored at the second memory unit in the form of a backup, the control unit is configured to store the read information on the lifespan of the consumable product to the second memory unit after updating the information on the lifespan of the consumable product.

8. A method of controlling an image forming apparatus configured to form a color image by having a consumable product, the method comprising:

reading information of a lifespan of the consumable product from a consumable product memory unit installed at the consumable product;

determining whether a first memory unit detachably coupled to a main board requires updating;

storing, if determined that the first memory unit requires updating, the read information on the lifespan of the consumable product at the first memory unit in the form of a backup;

determining whether a second memory connected to the main board requires updating;

storing, if determined that the second memory requires updating, the read information on the lifespan of the consumable product at the second memory unit in the form of a backup; and updating the information of the lifespan of the consumable product according to the amount of the consumption of the consumable product being used during a printing process, and storing the updated information on the lifespan of the consumable product to the consumable product memory unit, wherein in the storing at the first memory unit in the form of a backup, when the read information of the lifespan of the consumable product from the consumable product memory unit is determined to be shorter than the information of the lifespan stored at the first memory unit in the form of a backup, the information of the lifespan of the consumable product stored at the first memory unit is updated.

9. The method of claim 8, wherein:

in the storing at the second memory unit in the form of a backup, in a case when the read information of the lifespan of the consumable product is determined to be shorter than the information of the lifespan stored at the second memory unit in the form of a backup, the information of the lifespan of the consumable product stored at the second memory unit is updated.

* * * * *